US005782622A

United States Patent [19]

Ozu et al.

[11] Patent Number: 5,782,622

[45] Date of Patent: Jul. 21, 1998

[54] HERMETIC COMPRESSOR HAVING A FRAME SUPPORTING THE COMPRISSION MECHANISM

[75] Inventors: Masao Ozu; Izumi Onoda, both of Fuji, Japan

[73] Assignee: Kabushiki Kaisha Toshiba, Kawasaki, Japan

[21] Appl. No.: 755,024

[22] Filed: Nov. 22, 1996

[30] Foreign Application Priority Data

Dec. 11, 1995 [JP] Japan ..... 7-321701

[51] Int. Cl.[6] ..... F04C 18/356; F04C 29/06

[52] U.S. Cl. ..... 418/63; 418/179; 418/181

[58] Field of Search ..... 418/63, 179, 181, 418/270

[56] References Cited

U.S. PATENT DOCUMENTS 4,943,216 7/1990 Iio ..... 418/270

FOREIGN PATENT DOCUMENTS 2-146286 6/1990 Japan ..... 418/63

5-288179 11/1993 Japan ..... 418/63

*Primary Examiner*—John J. Vrablik

*Attorney, Agent, or Firm*—Cushman Darby & Cushman Intellectual Property Group of Pillsbury Madison & Sutro LLP

[57] ABSTRACT

A hermetic compressor which compresses compressed gas, comprising a sealing container, a compression mechanism, contained within said sealing container, for compressing said compressed gas, said compression mechanism including a rotary shaft, a motor for actuating the compression mechanism by driving the rotary shaft, first and second bearings, arranged individually on both sides of the compression mechanism, for journaling said rotary shaft, and a frame for fixedly supporting the compression mechanism, the frame comprises a frame body having a hollow portion in which said first bearing is situated, said frame body being fixed on one end surface of the compression mechanism and a bearing support portion for sealing the hollow portion of the frame body and supporting an outer peripheral portion of the first bearing.

11 Claims, 4 Drawing Sheets

HERMETIC COMPRESSOR HAVING A FRAME SUPPORTING THE COMPRISSION MECHANISM

BACKGROUND OF THE INVENTION

1. Field of the Invention

The present invention relates to a hermetic compressor used in air conditioners, etc., and in particular, to improvement in its noiseless structure.

2. Description of the Related Art

A hermetic compressor, which is employed in refrigerating cycle devices such as air conditioners, refrigerators, etc., includes an electric motor and a compression mechanism, which are housed in a sealing container. The compression mechanism is installed in a sealing container by means of a frame. Moreover, the compression mechanism is fitted with a muffler. One end of a rotary shaft of the electric motor extends into the compression mechanism, and is formed with an eccentric portion.

The compression mechanism is provided with a main bearing and a sub-bearing which are individually mounted to opposite end faces of a cylinder so that a compression chamber is formed in the cylinder, and which pivotally support the rotary shaft, and a roller which is located in the compression chamber so as to be eccentrically rotatable and which fits with the eccentric portion of the rotary shaft. Also, the cylinder and the frame are firmly clamped together by means of bolts.

In such a hermetic compressor, when the electric motor is driven, the rotary shaft is rotated, and the roller is eccentrically rotated in the compression chamber. Whereby compressed gas introduced into the compression chamber is compressed to make the gas high pressure. Then, the compressed gas pressurized to a predetermined pressure is discharged into the sealing container from a discharge port through the muffler.

The compression mechanism is installed in the sealing container by means of the frame as described above. This frame is normally formed of plate and cast materials. The frame thus formed is serves to securely maintain an accuracy of the parts of the compression mechanism which are finished with high precision, and to reinforce the sealing container. Further, the frame has vibration system noise reduction effect. However, the frame is formed at its center with an opening portion for installing the main bearing of the compression mechanism, etc., and has a circular ring shape. Therefore, the frame lacks rigidity.

On the other hand, the muffler has a function of reducing noise caused in the compression mechanism by passing the compressed gas discharged from the compression chamber therethrough. In general, the muffler can achieve improvement in noise reduction by having an increased thickness and large size in its structure. However, when installing the muffler in the compression mechanism, the cylinder and the main bearing are clamped together by means of bolts. For this reason, the muffler must be formed into a complicated shape in the vicinity of the bolts. This hinders not only increasing the thickness of the muffler and also makes the volume of the muffler large. As a consequence, noise reduction effect by the muffler can not be sufficiently achieved.

SUMMARY OF THE INVENTION

An object of the present invention is to provide a hermetic compressor which is capable of reducing vibration and noise.

To solve the above problems and achieve the above object, the present invention provides a hermetic compressor which compresses compressed gas, comprising a sealing container, a compression mechanism, contained within said sealing container, for compressing said compressed gas, said compression mechanism including a rotary shaft, a motor for actuating the compression mechanism by driving the rotary shaft, first and second bearings, arranged individually on both sides of the compression mechanism, for journaling said rotary shaft, and a frame for fixedly supporting the compression mechanism, the frame comprises a frame body having a hollow portion in which said first bearing is situated, said frame body being fixed on one end surface of the compression mechanism and a bearing support portion for sealing the hollow portion of the frame body and supporting an outer peripheral portion of the first bearing.

In the present invention, the hollow portion of the frame for installing the cylinder in the sealing container, is formed with a bearing support portion for supporting the first bearing defining the compression chamber, so that the rigidity of the frame can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
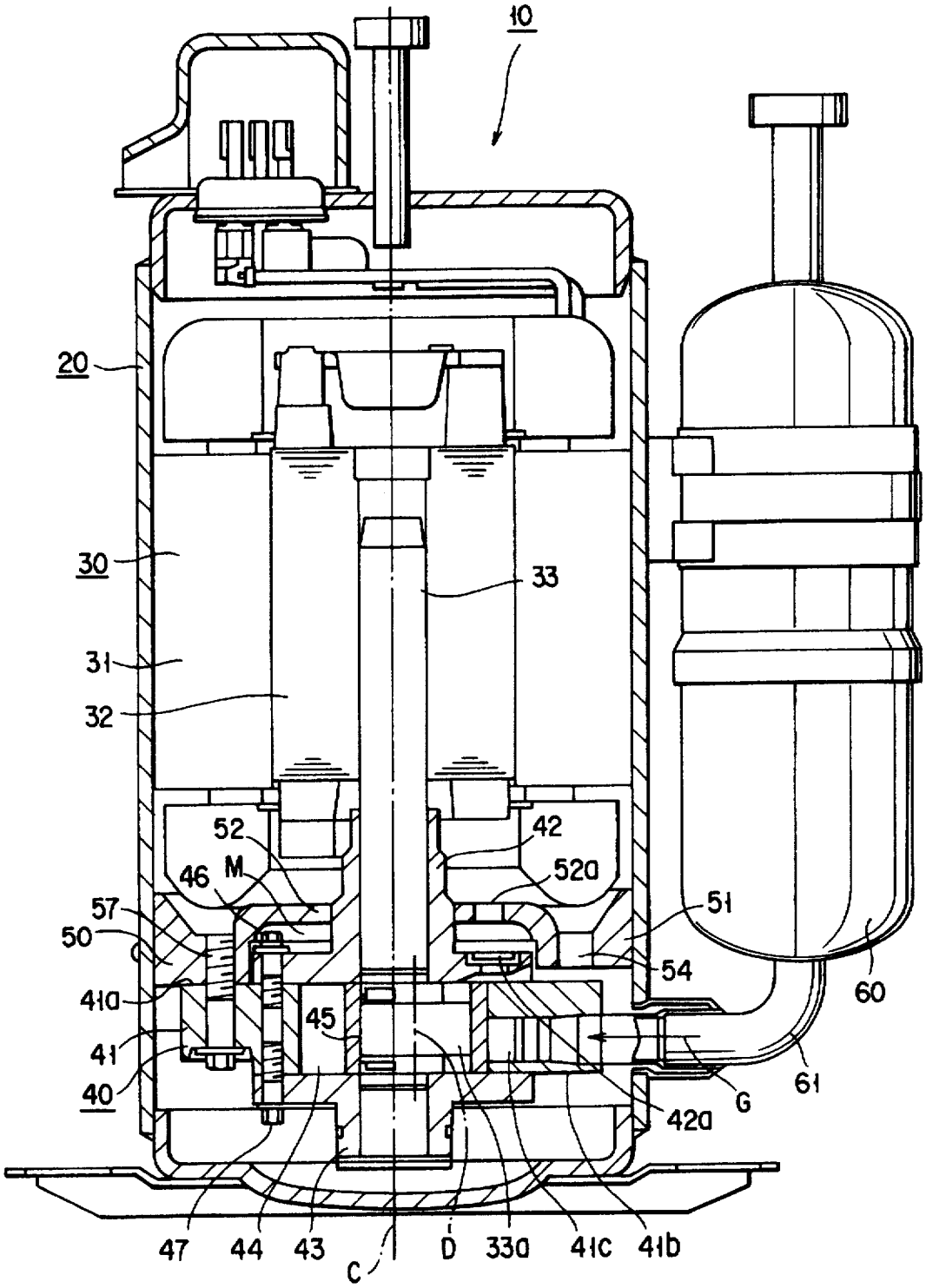
FIG. 1 is a hermetic compressor according to a first embodiment of the present invention, showing a longitudinal sectional view of the hermitic compressor cut along the line I—I of FIG. 3 and viewed from the direction indicated by arrows.
Figure 2:
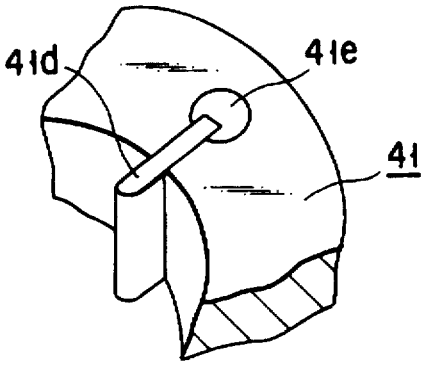
FIG. 2 is a perspective view showing a cylinder and a blade incorporated into the hermetic compressor according to the first embodiment.
Figure 3:
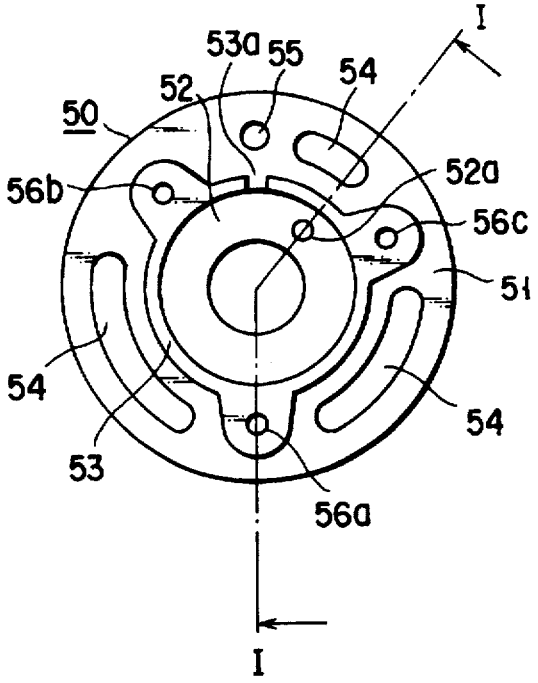
FIG. 3 is a bottom view of a frame incorporated into the hermetic compressor according to the first embodiment.
Figure 4:
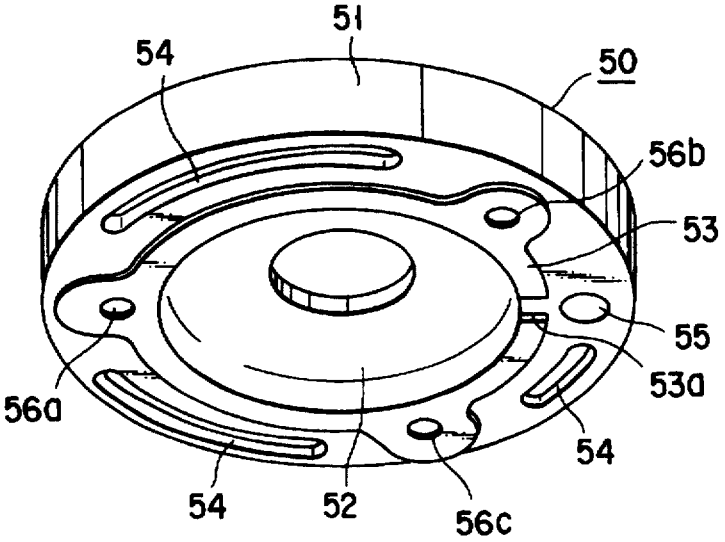
FIG. 4 is a perspective view of the frame incorporated into the hermetic compressor according to the first embodiment.

FIG. 1 is a hermetic compressor 10 according to a first embodiment of the present invention, showing a longitudinal sectional view cut along the line I—I of FIG. 3 and viewed from the direction indicated by arrows. FIG. 2 is a perspective view showing a positional relationship between a cylinder 41 and a blade 41*d* which are incorporated into a sealing container 20. FIG. 3 is a bottom view of a frame 50, and FIG. 4 is a perspective view of the frame 50.

The hermetic compressor 10 includes a sealing container 20, an electric motor 30 (rotary drive mechanism) housed in the sealing container 20, a compression mechanism 40, and a frame 50 which supports the compression mechanism 40 in the sealing container 20. Also, in FIG. 1, reference numerals 60 and 61 denote an accumulator and a suction pipe, respectively.

The electric motor 30 is provided with a stator 31 which is mounted to an inner wall of the sealing container 20, a rotor 32 which is rotatably located in a hollow of the stator 31, and a rotary shaft 33 which is fixed in the center of the rotor 32. Also, one side of the rotary shaft 32 is formed with an eccentric portion 33*a* extending into a cylinder 41 which will be described later.

The compression mechanism 40 is provided with a cylinder 41; a main bearing 42 (first bearing) and a sub-bearing 43 (second bearing) which are individually fitted to the first end face 41*a* and the second end face 41*b* of the cylinder 41 so that a compression chamber 44 which will be described later can be formed, and which pivotally support the rotary shaft 33; a compression chamber 44 formed in the cylinder 41; and a roller 45 which is located in the compression chamber so as to be eccentrically rotatable, and which fits with the eccentric portion 33*a* of the rotary shaft 33. Also, the cylinder 41 and the main bearing 42 and the sub-bearing 43 are connected by means of bolts 46 and 47. In FIG. 1, a dotted chain line C shows an axis of the rotary shaft 33; on the other hand, a dotted chain line D shows an axis of the roller 45.

As shown in FIGS. 1 and 2, the cylinder 41 is provided with a suction port 41*c* for introducing a compressed gas G into the compression chamber, a blade 41*d* whose distal end elastically abuts against the outer peripheral surface of the roller 45 so as to partition the compression chamber 44, and a blade hole 41*e* in which a spring for elastically pressing the blade 41*d* against the roller 45 is housed. The main bearing 42 is formed with a discharge port 42*a* for discharging the compressed gas G compressed in the compression chamber 44.

The frame 50 is formed of a cast material having a damping factor equal to a steel or more. As shown in FIG. 3 and FIG. 4, the frame 50 is composed of a cylindrical frame body 51 which is fixed on the side the first end face 41*a* of the cylinder 41 so that the main bearing 42 is positioned in a hollow portion of the frame body, a bearing support portion 52 which closes the hollow portion of the frame body 51 and supports the outer peripheral portion of the main bearing 42, and a ring-shaped metal contact portion 53 disposed on the side the first end face 41*a* of the cylinder 41 in the frame body 51. Also, the bearing support portion 52 is arranged with a predetermined distance from the first end face 41*a* of the cylinder 41 so that a muffler chamber M is defined between the main bearing 42 and the bearing support portion.

The bearing support portion 52 is formed with a discharge hole 52*a* for discharging the compressed gas G introduced in the muffler chamber M into the sealing container 20. On the other hand, the metal contact portion 53 airtightly contacts with the first end face 41*a* of the cylinder 41 to airtightly close the muffler chamber M. Further, the part of the metal contact portion 53 is formed with a notch portion 53*a* so as not to hinder movement of the blade 41*d*.

In FIG. 3 and FIG. 4, reference numeral 54 denotes an oil slot for returning lubricating oil to the bottom of the sealing container 20, and reference numeral 55 denotes a hole for supplying lubricating oil to the blade hole 41*e*. Each of reference numerals 56*a* to 56*c* denotes a bolt through-hole, and the bolt is threaded therethrough, whereby the cylinder 41 and frame 50 are firmly clamped together.

The muffler chamber M performs a function of reducing noise by passing the compressed gas G discharged from the discharge port 42*a* therethrough and thereafter, discharging it into the sealing container 20 through the discharge hole. Moreover, the frame body 51 and the first end face 41*a* of the cylinder 41*a* abut against each other, so that the cylinder 41 side on the muffler chamber M can be airtightly closed. This serves to reduce the number of components required for airtightly closing the muffler chamber.

The foregoing hermetic compressor 10 compresses the compressed gas G as follows. Specifically, when driving the electric motor 30, the rotary shaft 33 is rotated with the roller 45 being eccentrically rotated in the compression chamber 44. Simultaneously, the compressed gas G supplied from accumulator 60 is introduced into the compression chamber 44 through a suction pipe 61 and the suction port 41*c*. The compression chamber 44 is partitioned by the roller 45 and the blade 41*d*, and the volume of the partitioned compression chamber is gradually reduced as the rotary shaft rotates. Therefore, the compressed gas G in the chamber is compressed, so that it becomes high pressure. Substantially, the compressed gas G pressurized to a predetermined pressure is discharged into the muffler chamber M through the discharge port 42*a*. Further, the compressed gas G discharged into the muffler chamber M is discharged into the sealing container 20 through the discharge hole 52*a*.

Figure 5:
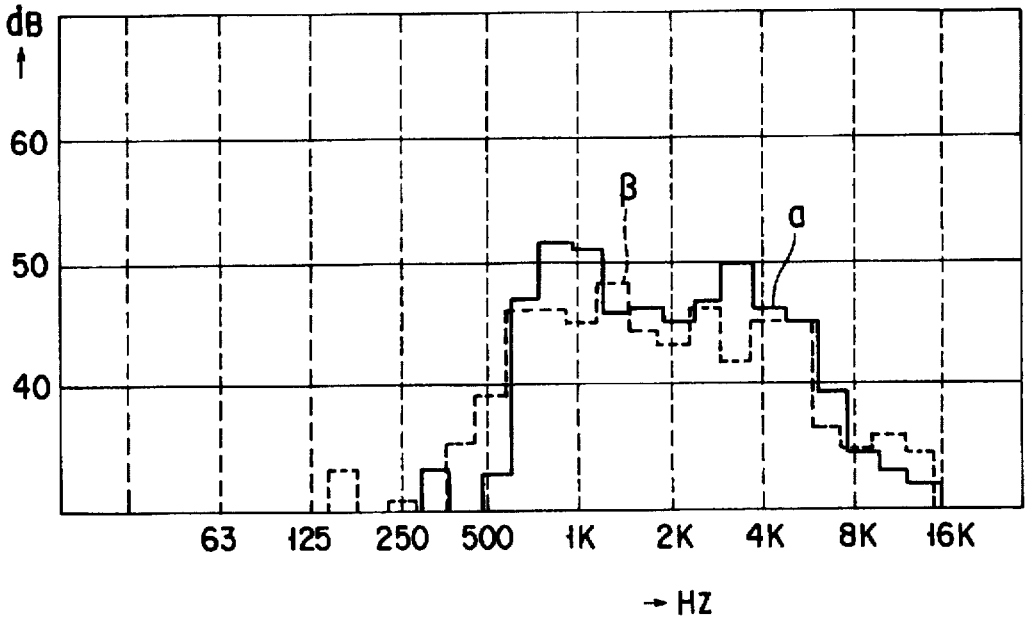
FIG. 5 is a graph showing noise level to make a comparison between the noises of the hermetic compressor according to the first embodiment and a conventional hermetic compressor.

In the hermetic compressor 10, the muffler chamber M is defined by using the frame 50 as described above, so that the rigidity of the frame 50 itself can be improved. Therefore, this serves to improve reinforcement effect of the sealing container 20 and to reduce noise in the vibration system. Moreover, there is no need of forming a bolt attachment portion for separately attaching the muffler chamber M, so that the volume and thickness of the muffler chamber M can be increased. This serves to improve sound isolation characteristics. In addition, a noise frequency amplified in the muffler is readily handled. Also, the frame 50 is formed of a cast material having a damping factor equal to a steel or more, so that vibration and noise can be further reduced by damping effect of the cast material. As is evident from a graph shown in FIG. 5, noise as indicated by a broken line $\beta$ of the hermetic compressor 10 is lower than noise as indicated by a solid line $\alpha$ of the conventional hermetic compressor.

Figure 6:
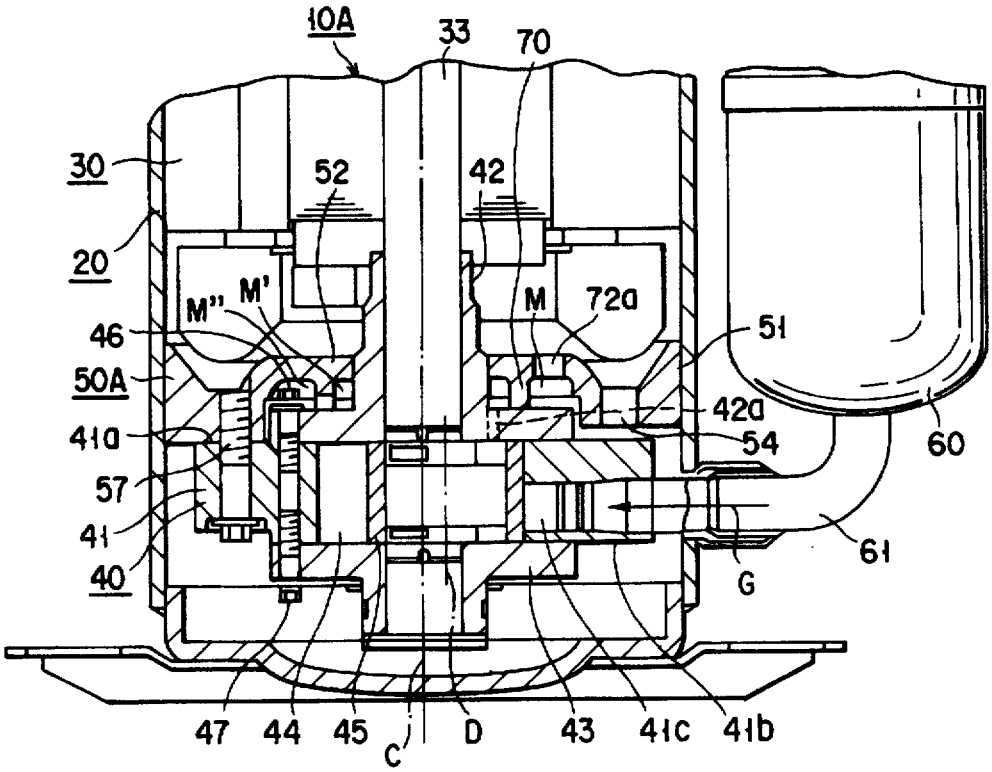
FIG. 6 is a longitudinal sectional view showing principle parts of a hermetic compressor according to a second embodiment of the present invention.
Figure 7:
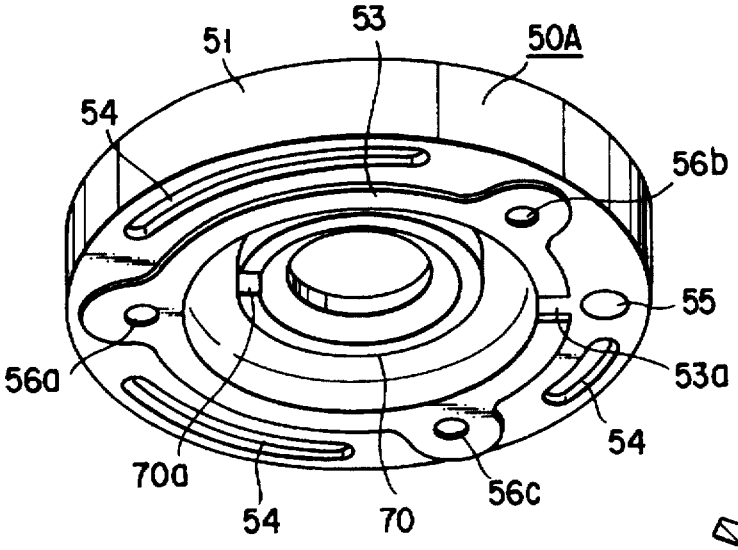
FIG. 7 is a perspective view of a frame incorporated into the hermetic compressor according to the second embodiment.

FIG. 6 is a longitudinal sectional view showing principle parts of a hermetic compressor 10A according to a second embodiment of the present invention; FIG. 7 is a perspective view of a frame 50A incorporated into the hermetic compressor 10A according to the second embodiment. In this case, a description on construction of the hermetic compressor 10A of the second embodiment will be omitted because it is substantially same as that of the first embodiment described above.

The hermetic compressor 10A differs from the hermetic compressor 10 in that the bearing support portion 52 of frame 50A is formed with a cylindrical wall portion 70 located coaxially with the main bearing 42. Specifically, the wall portion 70 divides the muffler chamber M into two chambers, that is, a muffler chamber M' on the rotary shaft 33 side and a muffler chamber M" outside the chamber M'. In FIG. 7, reference numeral 70*a* denotes a hole for introducing the compressed gas G discharged in the muffler chamber M' into the muffler chamber M".

In the hermetic compressor 10A constructed as described above, when being driven in the same manner as the foregoing hermetic compressor 10, the compressed gas G discharged from the discharge port 42*a* passes through the muffler chamber M', the muffler chamber M", successively, and thereafter, is discharged into the sealing container 20 through the discharge hole 52*a*. This serves to improve noise reduction effect by the muffler chamber M. On the other hand, the wall portion 70 is formed integrally with the frame 50A. Therefore, this serves to partition the muffler chamber M without adding a new manufacture process.

As described above, the hermetic compressor 10A of the second embodiment has advantages of partitioning the muffler chamber M without newly adding particular members, and of improving noise reduction effect.

Figure 8B:
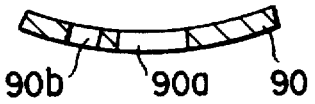
FIG. 8B is a cross sectional view of a partition member, showing a state before the partition member is mounted to the hermetic compressor according to the third embodiment.
Figure 8A:
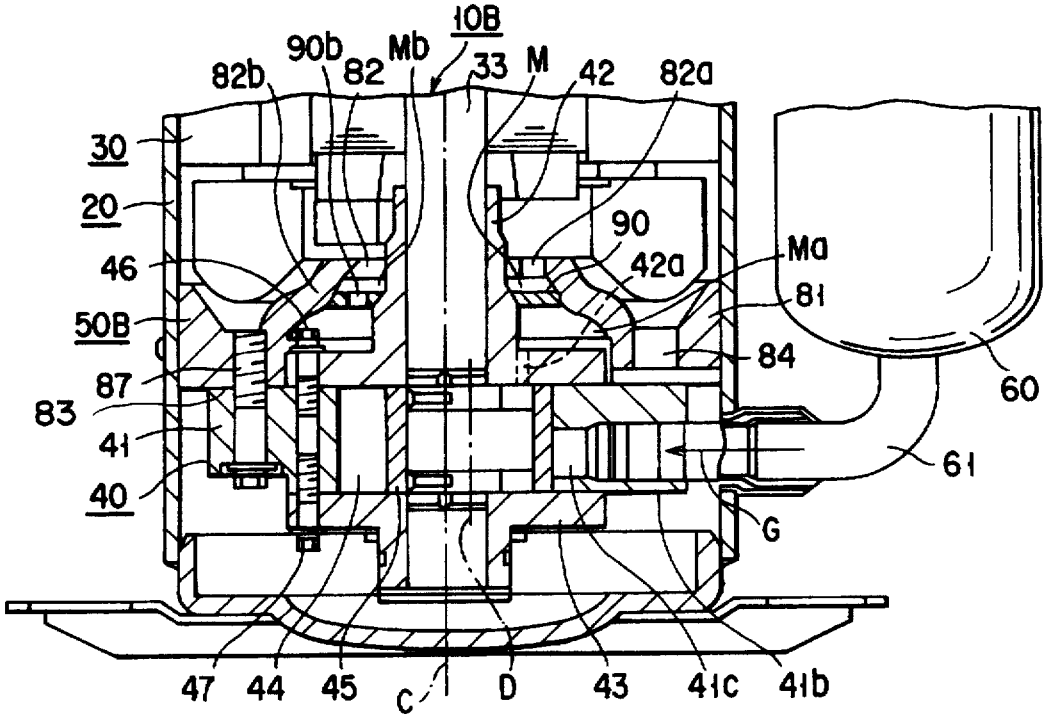
FIG. 8A is a longitudinal sectional view showing principle parts of a hermetic compressor according to a third embodiment of the present invention.

FIG. 8A is a longitudinal sectional view showing principle parts of a hermetic compressor 10B according to a third embodiment of the present invention; and FIG. 8B is a cross sectional view of a partition member, showing a state before the partition member is mounted to the hermetic compressor 10B according to the third embodiment. In this case, a description on construction of the hermetic compressor 10B of the second embodiment will be omitted because it is substantially same as that of the first embodiment described above.

The hermetic compressor 10B differs from the hermetic compressor 10 in that the hermetic compressor 10B uses a frame 50B in place of the frame 50.

The frame 50B is formed of a cast material having a damping factor equal to steel or more. As shown in FIG. 8A, the frame 50B is composed of a cylindrical frame body 81 which is fixed on the side to the first end face 41*a* of the cylinder 41 so that the main bearing 42 is positioned in a hollow portion of the frame body 81, a bearing support portion 82 which closes the hollow portion of the frame body 81 and supports the outer peripheral portion of the main bearing 42, and a ring-shaped metal contact portion 83 disposed on the side of the first end face 41*a* of the cylinder 41 in the frame body 81. Also, the bearing support portion 82 is arranged at a predetermined distance from the first end face 41*a* of the cylinder 41 so that a muffler chamber M is defined between the main bearing 42 and the bearing support portion.

The bearing support portion 82 is formed with a discharge hole 82*a* for discharging the compressed gas G introduced in the muffler chamber M into the sealing container 20. On the other hand, the metal contact portion 83 airtightly contacts with the first end face 41*a* of the cylinder 41 to airtightly close the muffler chamber M. In FIG. 8A, reference numeral 84 denotes an oil slot for returning lubricating oil to the bottom of the sealing container 20. A bolt 87 is threaded through the frame 50B, whereby the cylinder 41 and frame 50B are firmly clamped together.

The bearing support portion 82 is fitted with an iron partition member 90 arranged so as to be orthogonal to the axis C of the rotary shaft. The partition member 90 divides the muffler chamber M into two chambers, that is, a lower-side muffler chamber Ma and a upper-side muffler chamber Mb as shown in FIG. 8A. In FIG. 8A, reference numeral 82*b* denotes a support portion which is formed on the bearing support portion 82 and supports the outer peripheral surface of the partition member 90. Also, in FIG. 8B, reference numerals 90*a* and 90*b* denote a hollow portion into which the main bearing 42 is fitted, and a hole for supplying the compressed gas G introduced into the muffler chamber Ma to the muffler chamber Mb, respectively.

In the hermetic compressor 10B constructed as described above, when being driven in the same manner as the foregoing hermetic compressor 10, the compressed gas G discharged from the discharge port 42*a* passes through the muffler chamber Ma, the muffler chamber Mb successively, and thereafter, is discharged into the sealing container 20 through the discharge hole 82*a*. This serves to improve noise reduction by the muffler chamber M.

On the other hand, the partition member 90 is formed into a shape of convex as shown in FIG. 8B. When assembling the hermetic compressor 10 B, the partition member 90 is pressed into the support portion 82*b* of the bearing support 82 to cause an elastic force. Thus, the outer periphery of the partition member 90 is fixedly fitted into the support portion 82*b* by means of the elastic force, so that a firmly secured mounting can be accomplished.

As described above, the hermetic compressor 10B of the third embodiment has advantages of partitioning the muffler chamber M by using simple members without executing welding process, etc., and of improving noise reduction effect.

The present invention is not restricted to individual embodiments described above. Specifically, the above embodiments are applied to a one-cylinder vertical shaft type rotary; however, these embodiment may be applied to a two-cylinder vertical shaft type rotary. Also, a cast material is used as a material for forming the frame in the above embodiments. In the case where a porous sintering material like the cast material is used as a material for forming the frame, damping factor of the sintering material is improved by controlling the porosity so as to be equal to the damping factor of steel or more. Vibration of the cylinder is damped when propagating through the sealing container; therefore, noise can be reduced. Moreover, forging and plate materials serve to damp vibration of the cylinder when propagating through the sealing container; therefore, noise can be reduced. Besides the above description, of course, various modifications can be carried out without diverging from the scope of claims of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A hermetic compressor which compresses a compressed gas, comprising:

a sealing container;

a compression mechanism, contained within said sealing container, for compressing said compressed gas, said compression mechanism including a rotary shaft;

a motor for actuating the compression mechanism by driving the rotary shaft;

first and second bearings, arranged individually on both sides of the compression mechanism, for journaling said rotary shaft; and a frame for fixedly supporting the compression mechanism, wherein said frame comprises:

a frame body having a hollow portion in which said first bearing is situated, said frame body being fixed on one end surface of the compression mechanism; and a bearing support portion for sealing the hollow portion of the frame body and supporting an outer peripheral portion of the first bearing, wherein said compression mechanism comprises:

a cylinder;

said rotary shaft situated coaxially within the cylinder; and said first and second bearings, disposed on both end surfaces of the cylinder, for rotatable supporting the rotary shaft and defining a compression chamber within the cylinder.

2. The hermetic compressor according to claim 1, in which said first bearing is provided with a discharge port for discharging said compressed gas compressed in said compression chamber to the outside of the compression chamber.

3. The hermetic compressor according to claim 2, in which a muffler chamber is defined between said bearing support portion and said first bearing so that said compressed gas discharged from said discharge port is introduced therein.

4. The hermetic compressor according to claim 2, in which a cylinder side of said muffler chamber is airtightly closed by abutting said frame body against said end face of the cylinder.

5. The hermetic compressor according to claim 3, in which said muffler chamber is provided with a wall portion for partitioning said muffler chamber into a plurality of spaces.

6. The hermetic compressor according to claim 5, in which said wall portion extends along the axis of said rotary shaft.

7. The hermetic compressor according to claim 5, in which said wall portion is a plate-like member extending along the direction orthogonal to the axis of said rotary shaft.

8. The hermetic compressor according to claim 1, in which said frame is formed of a cast material having a damping factor equal to steel or more.

9. The hermetic compressor according to claim 1, in which said frame is formed of a sintering material having a damping factor equal to steel or more.

10. The hermetic compressor according to claim 1, in which said frame is formed of a forging material.

11. The hermetic compressor according to claim 1, in which said frame is formed of a plate material.

* * * * *